US005917390A

United States Patent [19]

Papallo, Jr. et al.

[11] Patent Number: 5,917,390

[45] Date of Patent: Jun. 29, 1999

[54] CIRCUIT BREAKER WITH CURRENT LIMITING CONTACT STRUCTURE

[75] Inventors: Thomas F. Papallo, Jr., Farmington; Randall L. Greenberg, Granby, both of Conn.

[73] Assignee: General Electric Company, Schenectady, N.Y.

[21] Appl. No.: 09/120,838

[22] Filed: Jul. 22, 1998

[51] Int. Cl.[6] ..... H01H 75/00

[52] U.S. Cl. ..... 335/16; 218/22

[58] Field of Search ..... 335/16, 147, 195; 218/22, 30, 31, 32, 33, 48, 49, 50, 146; 200/238, 243, 244, 245, 246

[56] References Cited

U.S. PATENT DOCUMENTS 4,656,444 4/1987 McKee et al. ..... 335/16
5,023,583 6/1991 Bratkowski et al. ..... 335/195

*Primary Examiner*—Lincoln Donovan
*Attorney, Agent, or Firm*—Cantor Colburn LLP; Carl B. Horton

[57] ABSTRACT

A circuit breaker having a shunting contact structure with low watts loss and high withstand level. The circuit breaker of the present invention comprises an upper contact arm having a first contact disposed thereon and a lower contact arm having second and third contacts thereon with the second contact mating with the first contact. A shunt terminal is provided between the upper contact arm and the lower contact arm. The shunt terminal includes a fourth contact which mates with the third contact on the lower contact arm. The circuit breaker of the current invention has a closed, open and current limiting position. When the circuit breaker is conducting nominal rated current, the first, second, third and fourth contacts remain closed. When the circuit breaker is under fault conditions which are circuit current conditions above the withstand level, the circuit breaker switches to a current limiting mode. In this mode, the upper contact arm and the lower contact arm move simultaneously in an upward and downward manner respectively, thereby opening the third and fourth contacts resulting in a blow open loop that opens the first and second contacts and protect a load coupled to the device from overcurrent conditions.

21 Claims, 7 Drawing Sheets

CIRCUIT BREAKER WITH CURRENT LIMITING CONTACT STRUCTURE

BACKGROUND OF THE INVENTION

1. Field of the Invention

This invention relates generally to an electrical distribution device, such as a circuit breaker and is more specifically directed to providing a circuit breaker having a circuit current limiting contact structure with low watts loss and high withstand level.

2. Brief Discussion of the Related Art

Electrical distribution devices are well known in the art. A conventional circuit breaker includes a pair of contacts which allows circuit current to pass from one contact member to another contact member. An object of these devices is to carry nominal rated current at very low watts loss and have momentary circuit current withstand levels, commonly referred to as "popping levels". A withstand level is generally the level of circuit current that may pass through the circuit breaker before a fault condition is realized causing the contacts to open to prevent circuit current from passing through the contacts. When the contacts open, circuit current is prevented from flowing from one contact member to the other and therefore, circuit current is prevented from flowing to a load which is connected to the device. By having these momentary circuit current withstand levels, operation under high inrush loads, common with motors and transformers, is permitted. Accordingly, these devices need to have momentary circuit current withstand levels so that they may be properly used with such high inrush loads to protect the loads and the overall electrical system.

It is also known in the art to provide a circuit breaker which offers a selective system. A conventional selective system uses large devices, normally air circuit breakers, with very high withstand levels in order to achieve selectivity. The disadvantage with this approach is that these devices do not limit the circuit current to reduce stress on the system. Consequently, these conventional selective systems are designed not to the required load on the system itself, but to the maximum available fault circuit current of the source. Therefore, the conventional selective systems concentrate and are designed in view of the source instead of the required loads on the system. As a result, the designs for the conventional systems are both physically larger and very costly.

Thus, there is a perceived need for a circuit breaker which offers the combination of high withstand and circuit current limiting performance in a single device and in addition the single device provides selectivity with upstream devices and backup protection of downstream devices.

SUMMARY OF THE INVENTION

An object of the invention is to provide a circuit breaker having an improved current limiting contact structure.

A more specific object of the invention is to provide a current limiting structure which has reduced watts loss compared to contemporary contact structures. By having a reduced watts loss, lower temperature rises results and higher continuous circuit current ratings are achieved.

Another specific object of the invention is to provide a contact structure which has higher withstand ratings than contemporary designs for contact structures. By providing higher withstand level settings, the circuit breaker may be more properly matched with the load and selectivity requirements of the system.

Yet another specific object of the invention is to provide a design for an improved contact structure which has the potential for high current limiting capability. Because of this advantageous capability, backup protection is accomplished and the contact structure design reduces the overall stress on the system.

These and other objects and advantages of the invention are obtained and the above-discussed and other drawbacks and deficiencies of the prior art are overcome or alleviated by the circuit breaker of the present invention. The circuit breaker of the present invention comprises at least one pair of contact arms with one being an upper contact arm and the other being a lower contact arm. At one end, the upper contact arm is pivotably coupled to a load terminal. At an opposite end, the upper contact arm contains a contact which is part of a main contact pair. At one end, the lower contact arm contains the other contact of the main contact pair and at an opposite end, the lower contact arm is pivotably coupled to a line terminal.

In accordance with the present invention, a shunt terminal is provided. The shunt terminal is a generally "U" shaped member having an upper portion and side portions integrally connected to the upper portion at one end. The upper portion of the shunt terminal is disposed between the upper contact arm and the lower contact arm. At an opposite end thereof, the side portions are coupled with the line terminal. The upper portion of the shunt terminal includes a contact which is part of a shunting main contact pair. The other contact which forms the shunting main contact pair is disposed on the lower contact arm. Contact force is generated by an overcentering upper contact spring which acts upon the upper contact arm and an overcentering lower contact spring which acts on the lower contact arm to allow the upper contact arm and the lower contact arm to move simultaneously.

In accordance with the present invention, when the circuit breaker is conducting nominal rated circuit current, the circuit current path is through the load terminal, upper contact arm, main contact pair through the lower contact arm to the shunting main contact pair, and the shunt terminal to the line terminal. By employing the shunt terminal and the shunting main contact pair, the path of the circuit current to the line terminal is reduced because the circuit current does not have to flow along the length of the lower contact arm. At circuit currents above the nominal rating up to the withstand level, both the main contact pair and the shunting main contact pair remain closed. When the circuit breaker is under fault conditions, i.e., circuit current above the withstand level, the circuit breaker switches to a circuit current limiting mode. In a current limiting mode, the circuit breaker reduces the stress caused by the overcurrent conditions on the overall selective system. The current limitation would keep the let-thru circuit current below the withstand level of an upstream device (circuit breaker). In this mode, the upper contact arm and the lower contact arm move simultaneously in an upward and downward manner respectively. As the lower contact arm moves downward, the shunting main contact pair opens because one of the contact forming the pair is disposed on the lower contact arm which has moved downward. When the shunting main contact pair open, an anode-cathode voltage drop is generated in the circuit current path. The resistance of this anode-cathode drop causes the circuit current to transfer from the shunting main contact pair through the entire length of the lower contact arm to the line terminal. The resistance and inductance of this circuit current path can be low enough to allow circuit current commutation. In this mode, the circuit current path now forms a full blow open loop with the upper contact arm.

When the circuit breaker of the present invention is used in a two tier selective system as a downstream device, the circuit breaker in the current limiting mode keeps the let-thru circuit current below the withstand level of an upstream device (which also may comprise the circuit breaker of the present invention). Furthermore, the contact structure of the present invention, provides a reduced circuit current let-thru when the circuit breaker is in the current limiting mode and by reducing the circuit current let-thru, stresses on the entire system are reduced and performance is increased. In addition, because the upstream device of the system may have a high withstand, it does not trip and advantageously the remainder of the system remains in service. Consequently, the circuit breaker of the present invention offers the combination of high withstand and current limiting performance in a single device and provides selectivity with upstream devices and protection of downstream devices.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE INVENTION

Figure 1:
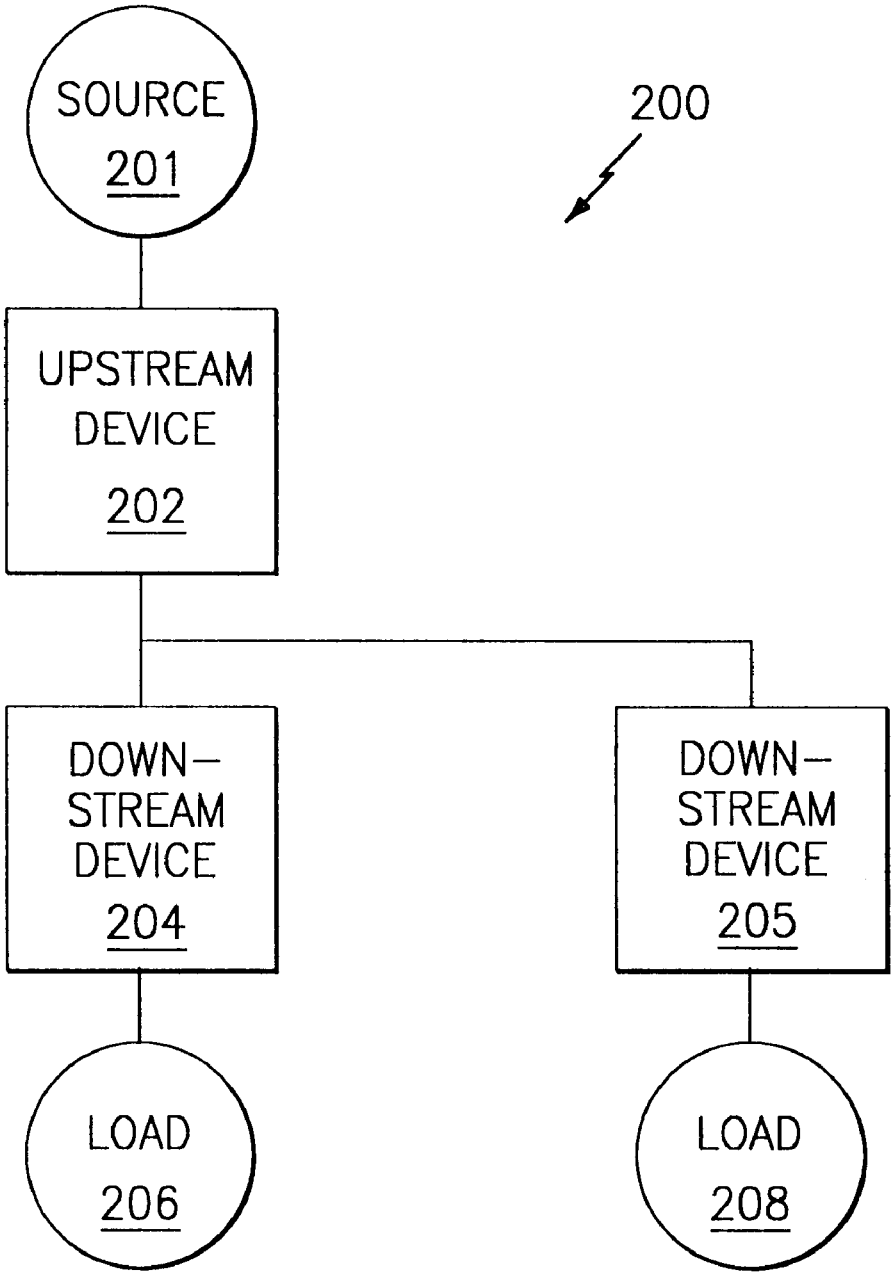
FIG. 1 is a block diagram of a two tier selective system in accordance with the present invention.

FIG. 1 is a block diagram illustrating a typical two tier selective system 200. System 200 comprises a source 201, an upstream device 202, a downstream device 204 and at least one corresponding load 206. Any number of additional downstream devices 205 with corresponding loads 208 may be included in system 200. The downstream device 204 is rated to meet the demand of load 206, e.g., 20× (twenty times) rated circuit current maximum. When load 206 exceeds this rating, which is likely only when a fault occurs, device 204 would then rapidly transition to a current limiting position. In the current limiting position, downstream device 204 has a reduced circuit current let-thru which in turn reduces stresses on the entire system 200. By reducing these stresses on system 200, the devices of load 206 is also protected and this is of particular interest if load 206 has a motor starter in the circuit thereof.

Figure 2:
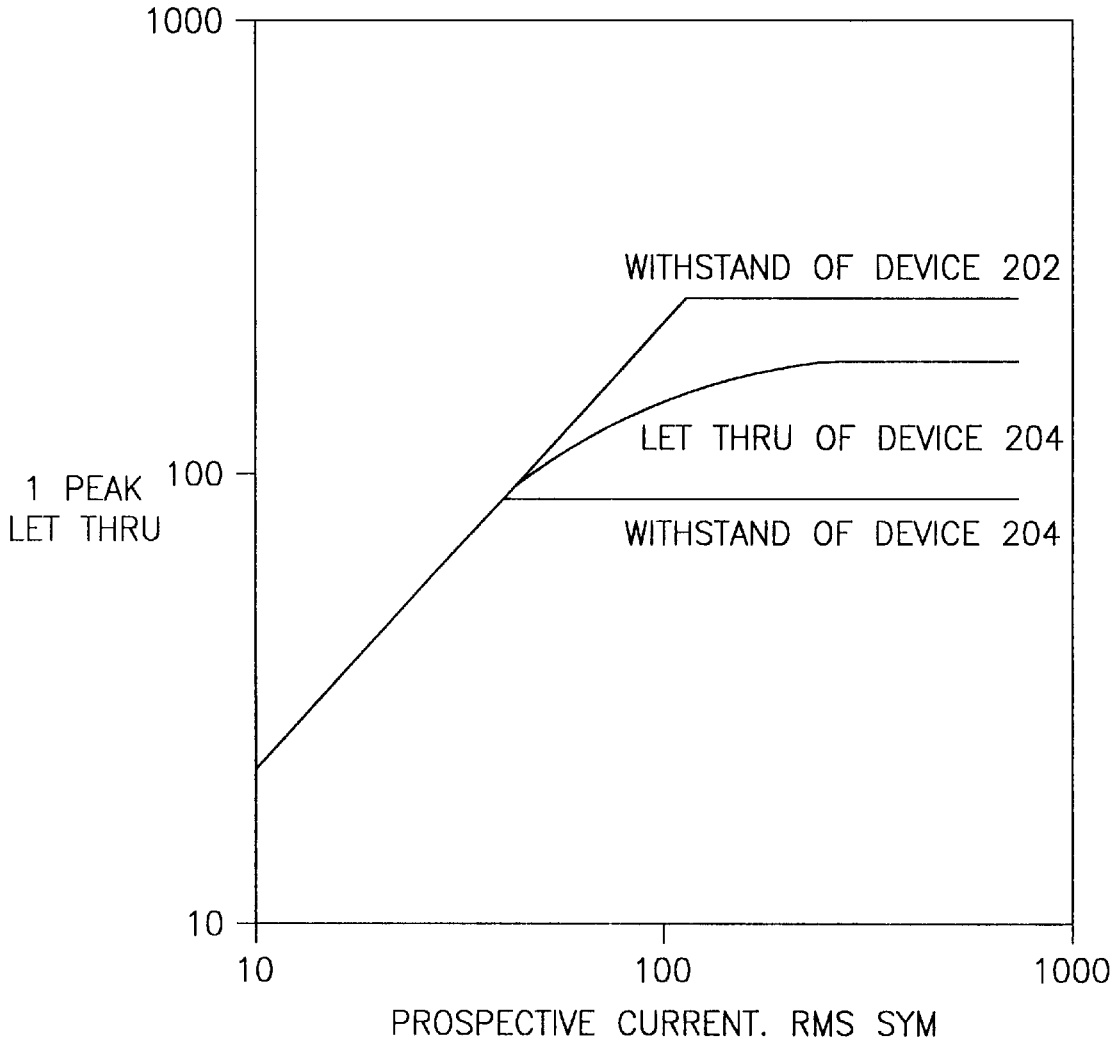
FIG. 2 is a plot of peak let-thru current versus prospective current of a two tier selective system in accordance with the present invention.

FIG. 2 is a plot of peak let-thru current versus prospective current of downstream device 204 and upstream device 202 in a current limiting position in accordance with the present invention. Downstream device 204 is in a current limiting position when device 204 is under fault conditions which are circuit current conditions substantially above the withstand level. In this position, downstream device 204 keeps the let-thru circuit current below the withstand level of the upstream device 202, as shown in FIG. 2. Because upstream device 202 can be of the same design as downstream device 204 and have a high withstand, it does not trip and the remainder of the system 200 remains in service. If upstream device 202 did not have a sufficiently high withstand level, then upstream device 202 would be prone to tripping and such tripping would cause the remainder of the system 200 to be out of service. By reducing the circuit current let-thru, downstream device 204 reduces the stresses on the entire system 200 and thereby protects the devices of load 206 as well.

Figure 3:
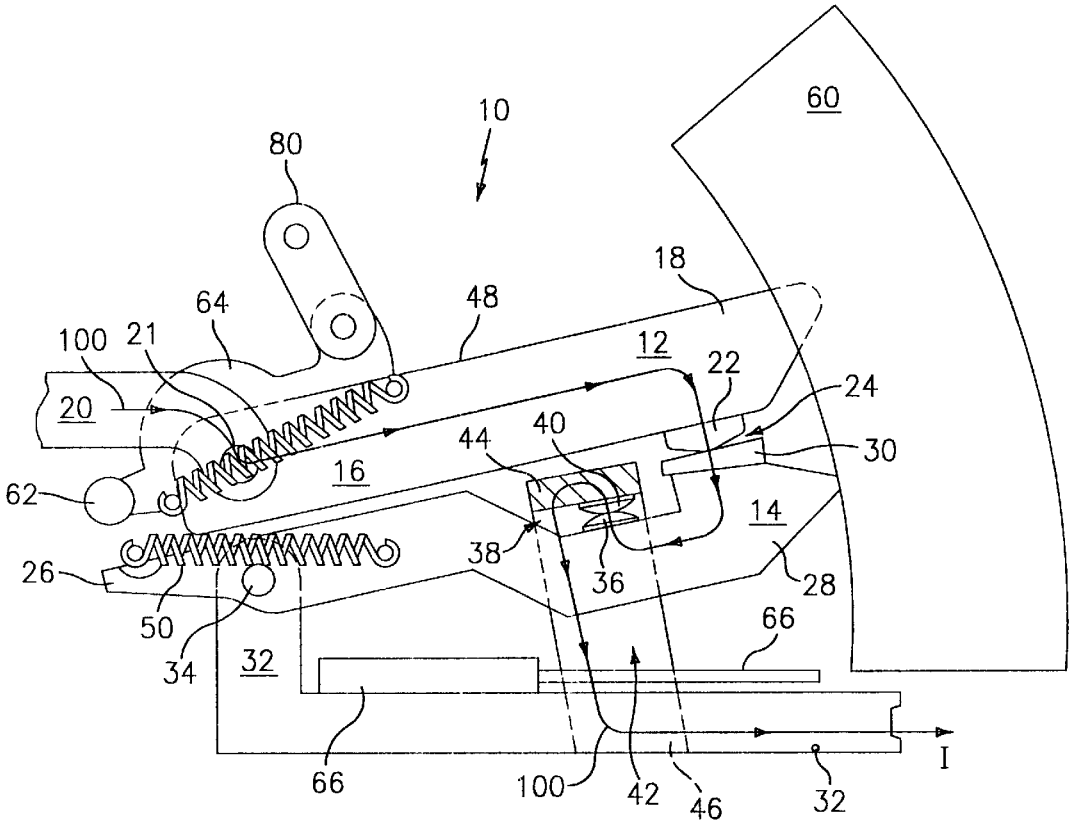
FIG. 3 is a side view of a circuit breaker in a closed position in accordance with the present invention.
Figure 4:
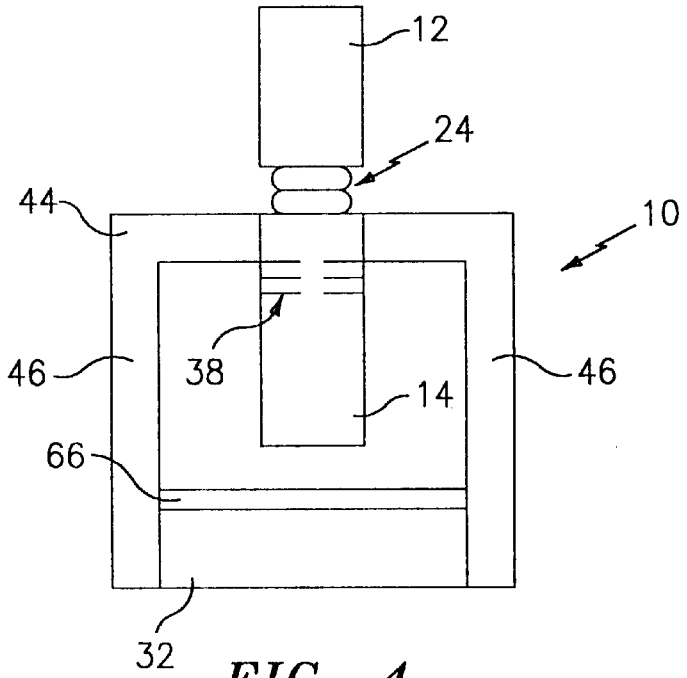
FIG. 4 is a partial rear view of the circuit breaker of FIG. 3.

Turning now to FIGS. 3 and 4, the circuit breaker of the present invention is generally shown at 10. In accordance with the present invention, downstream device 204 (FIG. 1) and upstream device 202 (FIG. 1) each comprise a circuit breaker 10. Circuit breaker 10 comprises an upper contact arm 12 and a lower contact arm 14. Upper contact arm 12 has a first end 16 and a second end 18. At first end 16 upper contact arm 12 is pivotably coupled to a load terminal 20 as is well known in the art, e.g., by use of a conducting joint or flexible conductor, generally shown at 21. Second end 18 of upper contact arm 12 contains a contact 22 which is part of a main contact pair 24. Lower contact arm 14 has a first end 26 and a second end 28. Second end 28 of lower contact arm 14 contains a contact 30 which along with contact 22 forms main contact pair 24. At first end 26 lower contact arm 14 is pivotably coupled to a line terminal 32 as is well known in the art, e.g., by use of a conducting joint or flexible conductor, generally indicated at 34. Line terminal 32 is a generally "L" shaped member. Disposed on lower contact arm 14 between contact 30 at second end 28 and first end 26 is a contact 36. A shunt terminal 42 is a generally "U" shaped member having an upper portion 44 and side portions 46. Disposed on upper portion 44 of shunt terminal 42 is a contact 40. Contact 36 and contact 40 comprise a shunting main contact pair 38. Upper portion 44 of shunt terminal 42 is disposed between upper contact arm 12 and lower contact arm 14 so that contact 40 mates with contact 36 of the lower contact arm 14. At a first end 45, side portions 46 are integrally connected to upper portion 44 and at a second end 47, side portions 46 are coupled to line terminal 32. Contact force is generated by overcentering springs (or overcentering spring mechanisms) 48, 50, wherein upper contact spring 48 acts on upper contact arm 12 and lower contact spring 50 acts on lower contact arm 14.

FIG. 3 illustrates circuit breaker 10 in a closed position when circuit currents above the nominal rating up to the withstand rating of circuit breaker 10 are observed. When circuit breaker 10 is conducting normal rated circuit current in this closed position, a circuit current (I), indicated by a line 100 and flowing in the direction of the arrows, is through load terminal 20, upper contact arm 12, main contact pair 24 through lower contact arm 14 to shunting main contact pair 38, shunt terminal 42 to line terminal 32. The benefit of providing shunting main contact pair 38 is that the path of circuit current (I) is reduced. By employing shunt terminal 42 and shunting main contact pair 38 in circuit breaker 10 in accordance with the present invention, circuit current (I) is allowed to flow through shunting main contact pair 38 and shunt terminal 42 to line terminal 32 instead of flowing along the length of lower contact arm 14

(from second end 28 to first end 26) to the point of pivotal coupling between lower contact arm 14 and line terminal 32 and then flowing along the length of line terminal 32. Reducing the length of circuit current path 100 is of greater significance in current limiting circuit breakers because the movable cross conductor cross sections are small to reduce the mass for current limiting performance. Only second end 28 of lower contact arm 14 is in the circuit current path, so only this section (second end 28) needs to be increased thereby reducing the additional mass. Furthermore, shunt terminal 42 is stationary and can be of any cross section necessary to achieve the desired nominal rating without reducing current limiting performance.

At circuit currents above the nominal rating up to the withstand rating (the closed position), both main contact pair 24 and shunting main contact pair 38 of circuit breaker 10 remain closed and the circuit current (I) follows the path shown in FIG. 3. By providing shunting main contact pair 38 in circuit breaker 10, little or no circuit current flows through the first end 26 of the lower contact arm 14. In this closed position, there is no reverse loop trying to separate main contact pair 24 and shunting main contact pair 38. A reverse loop would be formed in circuit breaker 10 if circuit current flows along upper contact arm 12 in the direction from first end 16 to second end 18 and then circuit current is transferred to lower contact arm 14 where it flows in an opposite direction from second end 28 to first end 26. The flow of circuit current in opposite directions along upper contact arm 12 and lower contact arm 14 (reverse loop) causes upper contact arm 12 and lower contact arm 14 to repel from one another because of the opposing magnetic fields which are created by the reverse loop structure. Due to the forces of the opposing magnetic fields induced by the current flow, upper contact arm 12 and lower contact arm 14 are encouraged to part and thereby main contact pair 24 and shunting main contact pair 38 open. The elimination of the reverse loop structure in circuit breaker 10 is a significant advantage over conventional current limiting designs which suffer from the presence of a reverse loop which tries to separate the contact arms and contacts thereby making high withstand levels not achievable in the conventional current limiting designs. Contrarily in the present invention because the reverse loop structure has been eliminated, high withstand levels are achievable because the tendency for the main contact pair 24 and shunting main contact pair 38 to separate due to the presence of the reverse loop has been eliminated.

Upper contact spring 48 provides the proper mechanical force to the main contact pair 24 for withstand rating to be achieved in circuit breaker 10 of the present invention. Overcentering spring 50 provides approximately twice the force provided by upper contact spring 48 because the main contact pair 24 subtracts from the shunting main contact pair 38. Shunting main contact pair 38 must have a force similar to the main contact pair 24 in order for shunting main contact pair 38 to have the same withstand level.

Figure 5:
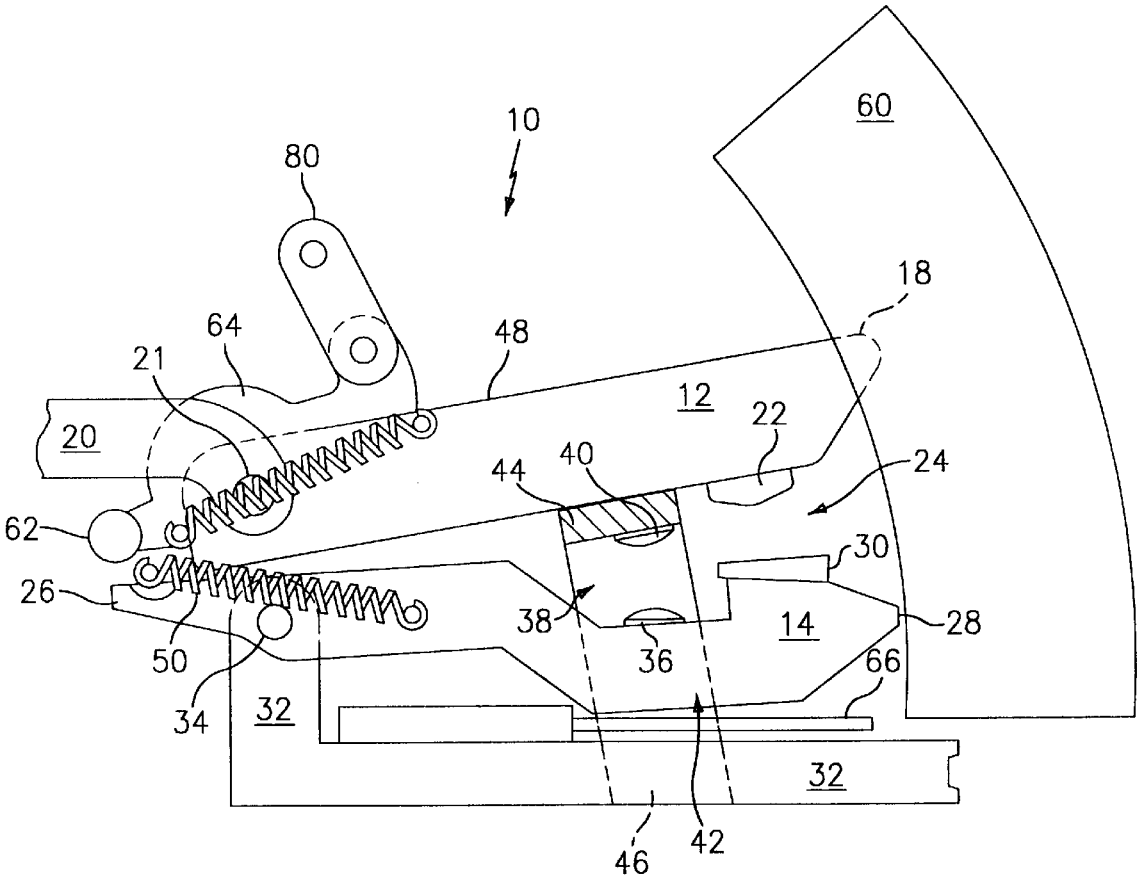
FIG. 5 is a side view of the circuit breaker in a current limiting position in accordance with the present invention.
Figure 6:
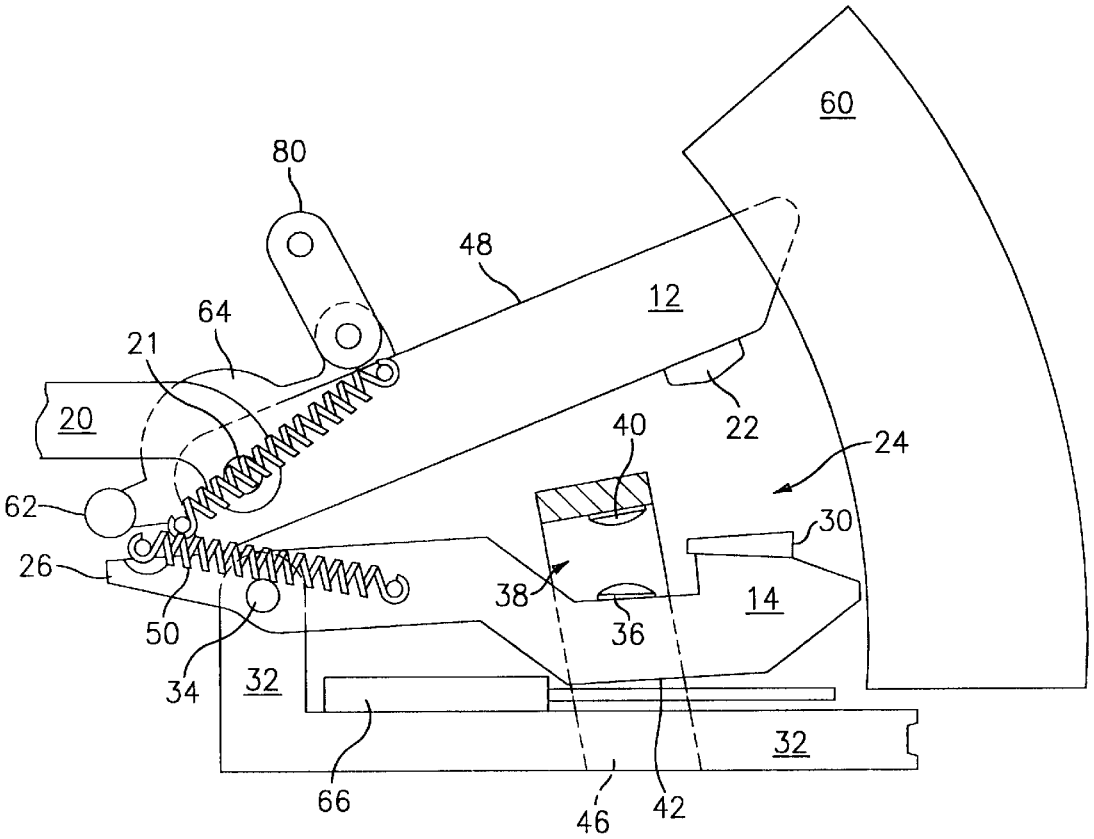
FIG. 6 is a side view of the circuit breaker in a second current limiting position in accordance with the present invention.

Now turning to FIG. 5 in which a second position of circuit breaker 10 is illustrated wherein circuit breaker 10 is in a current limiting position. In this second position, circuit breaker 10 is under fault conditions which are circuit current conditions substantially above withstand levels. Under fault conditions, current limiting performance is desired so that the overall stress on circuit breaker 10 and on selective system 200 (FIG. 1) is advantageously reduced. With reference to FIGS. 1 and 2 and as discussed hereinbefore, in a current limiting mode, the circuit current limitation would keep the let-thru circuit current below the withstand level of upstream device 202. Because upstream device 202 can be of the same design with high withstand as downstream device 204, it does not trip and the remainder of system 200 remains in service. In accordance with the present invention, upstream device 202 and downstream device 204 preferably comprise circuit breaker 10 of the present invention. In the current limiting mode, contact pairs 24, 38 will start to part because of contact constriction forces. Because upper contact arm 12 has only one contact (contact 22) and lower contact arm 14 has two contacts (contacts 36 and 30) with approximately twice the mechanical spring force, it is possible to adjust lower contact spring 50 such that upper contact arm 12 and lower contact arm 14 move simultaneously. Once lower contact arm 14 moves in a downwardly manner, shunting main contact pair 38 will open. Because contact 36 of shunting main contact pair 38 is disposed on lower contact arm 14, the downward movement of lower contact arm 14 causes an opening between contact 36 and contact 40 which is coupled to shunt terminal 42 at first end 44. When contact 36 and contact 40 open relative to one another, an anode-cathode voltage drop is generated in the circuit current (I). The resistance of this anode-cathode drop will then cause the circuit current to transfer from shunting main contact pair 38 through the entire length of lower contact arm 14 through conducting joint 34 to line terminal 32. The resistance and inductance of this circuit current path is low enough to allow circuit current (I) commutation. The circuit current path designated by line 100' now forms a full blow open loop with upper contact arm 12. Because this reverse loop is inactive at lower circuit currents and does not effect the withstand level, upper contact arm 12 and lower contact arm 14 can be located in closer proximity to enhance the blow open force, than can be achieved in conventional designs. Furthermore, the force will now accelerate upper contact arm 12 and lower contact arm 14 in opposite directions generating contact gap faster so that an arc extinguishing chute 60 is engaged more rapidly in order to generate arc voltage faster and enhance circuit current limitation. As upper contact arm 12 and lower contact arm 14 open, upper contact spring 48 and lower contact spring 50 overcenter and contribute to, rather than subtracting from, the acceleration of upper contact arm 12 and lower contact arm 14. Overcentered upper contact spring 48 and overcentered lower contact spring 50 also help prevent rebounding and reclosing and maintain shunting main contact pair 38 open during the interruption event. FIG. 6 illustrates circuit breaker 10 of the present invention in a further current limiting position subsequent to the second position as discussed hereinbefore and illustrated in FIG. 5. Circuit breaker 10 in FIG. 6 remains under fault conditions and in a current limiting position. FIG. 6 shows the position of circuit breaker 10 with the contact pairs 24 and 38 held open by the overcenter springs 48 and 50. Because of the overcenter action, the main contact pair 24 remain open, preventing further circuit current from flowing. After the interrupting event has ended, lower contact arm 14 is reset by a bump (stop) 62 on a crossbar 64, when circuit breaker 10 trips open. Crossbar 64 is rotatably coupled to upper contact arm 12 so that when circuit breaker 10 trips open, bump 62 contacts first end 26 of lower contact arm 14 and thereby resetting lower contact arm 14. Circuit breaker 10 also has an iron magnetic shield 66 which negates the attractive and repulsive field caused by the forward loop of the lower section of line terminal 32. By negating the repulsive field created by current flowing in the opposite direction to the circuit current path along lower contact arm 14 and the forward loop of the lower section of line terminal 32, lower contact arm 14 is not repelled by line terminal 32. Magnetic shield 66 also negates the attractive field created by circuit current flowing in the same direction as in the circuit current path along upper contact arm 12 and the forward loop of the lower section of line terminal 32, upper contact arm 12 is not attracted to line terminal 32 thereby causing the contact pairs 38 and 24 to separate rapidly.

Figure 7:
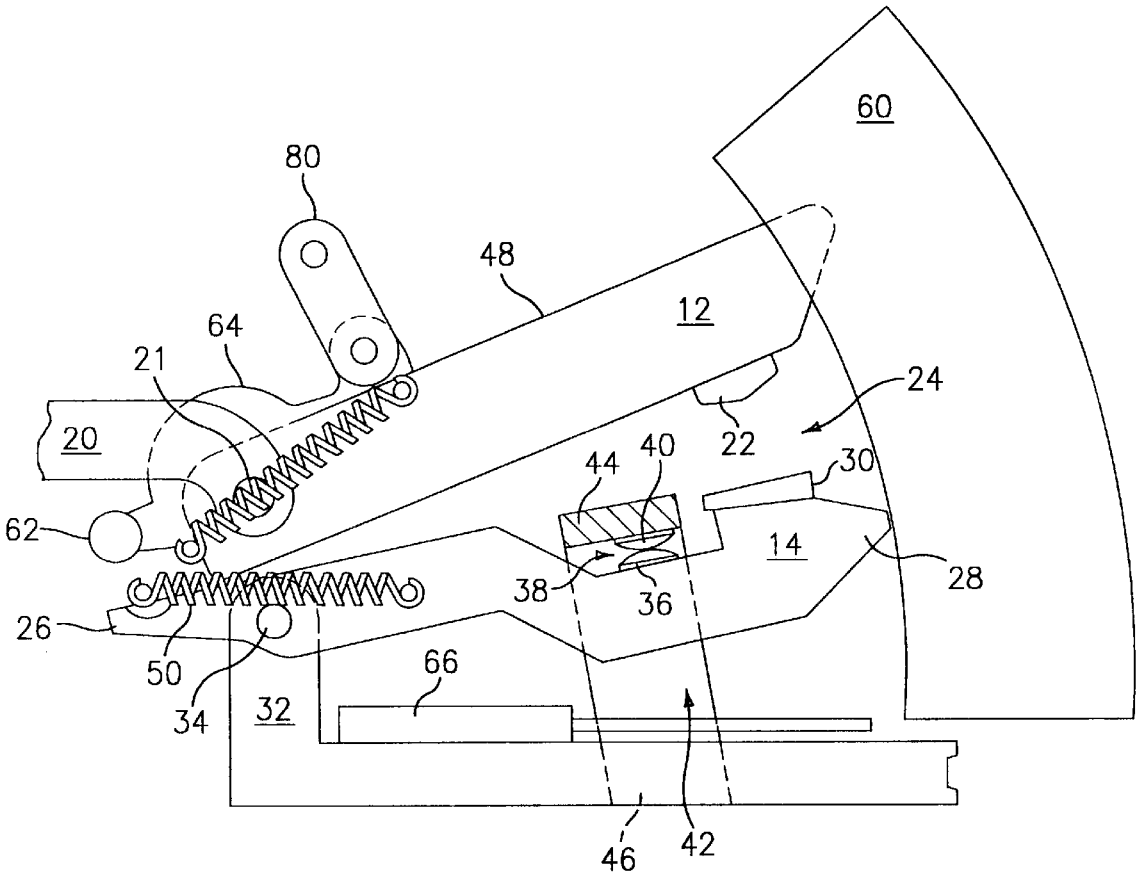
FIG. 7 is a side view of the circuit breaker in an open position in accordance with the present invention.

FIG. 7 illustrates circuit breaker 10 in a third position wherein circuit breaker 10 has been tripped by conventional operation of circuit breaker 10. Under sufficient overcircuit current conditions, circuit breaker 10 will open to remove the overcircuit current condition on the entire system and in particular on a load connected thereto. In this third position, upper contact arm 12 and lower contact arm 14 part relative to one another. Sufficient overcurrent conditions arise when the overcurrent is sufficient enough to cause a conventional operation by a trip unit, either thermal, magnetic, or electronic, so that upper contact arm 12 opens relative to lower contact arm 14. Because of the opening of main contact pair 24, no circuit current is allowed flowing from upper contact arm 12 to lower contact arm 14. In this third position, circuit breaker 10 functions as a conventional circuit breaker, the operation of which is known in the art and the system (i.e., loads) are taken out of service to protect the system (loads), also known as a protected circuit, from the overcurrent conditions which exist in the system. After the overcurrent conditions have been removed from the system, circuit breaker 10 is reset by conventional operating mechanisms, e.g. a switch mechanism. The operating mechanism (not shown) communicates with a crank 80. In a conventional operating system, crank 80 is connected to a flange (not shown) which in turn supports a switch (not shown) which moves crank 80 to different positions to open or close main contact pair 24 by movement of upper contact arm 12 relative to lower contact arm 14. Thus, circuit breaker 10 may be reset to a closed position after the fault conditions have been removed by means of the operating mechanism.

Figure 8:
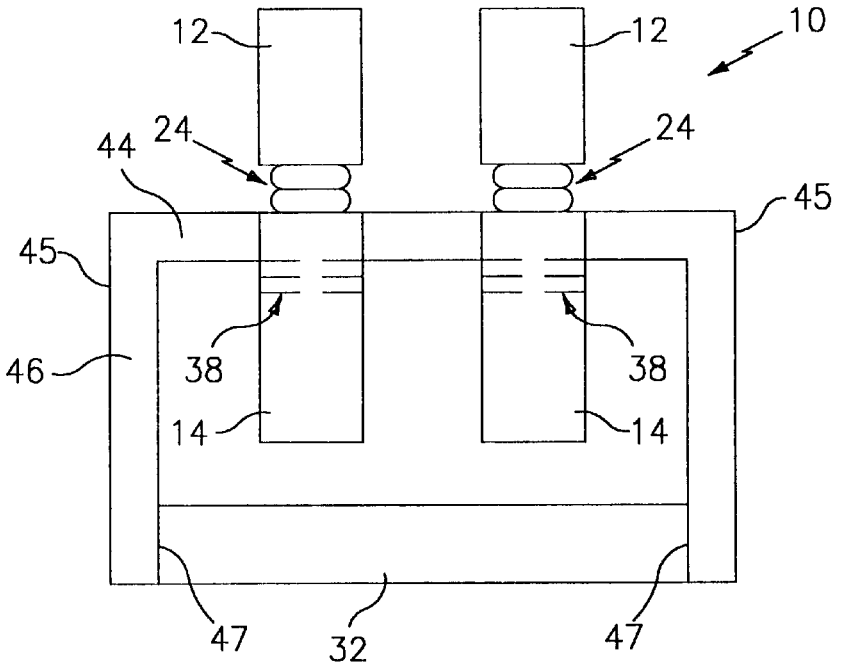
FIG. 8 is a partial rear view of an alternative embodiment of the present invention, wherein the circuit breaker has two arms.

FIG. 8 illustrates an alternative embodiment of the present invention wherein circuit breaker 10 comprises at least two upper contact arms 12 and at least two lower contact arms 14. In this alternative embodiment, the addition of contact arms reduces the contact resistance and thereby increases the continuous circuit current ratings that can be achieved using this design in a selective system. In this embodiment for each upper contact arm 12 and lower contact arm 14 that is employed in circuit breaker 10, there is a corresponding pair of main contacts 24 and a pair of shunting main contacts 38. Moreover, the withstand level of circuit breaker 10 is also increased because the proximity of contact pairs 24 and 38 is large compared to the contact constriction forces. But once the contacts part, the plurality of contact arms 12 and 14 are in close enough proximity that the blow open forces are additive and high accelerations are still achieved in circuit breaker 10.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A circuit breaker, comprising:

a pair of first and second separable contacts defining a first contact pair, a first contact arm carrying said first contact and being electrically connected to a first terminal;

a pair of third and fourth separable contacts defining a second contact pair;

a second contact arm carrying said second and third contacts, said second contact arm being electrically connected to a second terminal, said first and second contacts separable between open and closed positions; and a shunt terminal carrying said fourth contact, wherein said third and fourth contacts are separable between open and closed positions, said shunt terminal comprising a member for providing a first electrical path between said second contact arm and said second terminal, wherein said first and second pairs of contacts are separable under predetermined current conditions.

2. The circuit breaker of claim 1, wherein said first terminal comprises a load terminal.

3. The circuit breaker of claim 1, wherein said second terminal comprises a line terminal.

4. The circuit breaker of claim 1, wherein said shunt terminal comprises:

a generally "U" shaped member having an upper portion and side portions, said upper portion being disposed between said first contact arm and said second contact arm so that said fourth contact mates with said third contact.

5. The circuit breaker of claim 4, wherein said first and second contact arms are pivotably mounted.

6. The circuit breaker of claim 1, wherein said first electrical path is defined by said first, second, third and fourth contacts when said circuit breaker is in a closed position.

7. The circuit breaker of claim 1, further comprising:

a pair of springs for effecting opening and closing of said third and fourth contacts.

8. The circuit breaker of claim 7, wherein said pair of springs comprises:

a first spring coupled to said first contact arm and a second spring coupled to said second contact arm.

9. The circuit breaker of claim 1, wherein said first contact arm and said second contact arm are connected to move simultaneously with respect to one another when said circuit breaker is under fault conditions.

10. The circuit breaker of claim 1, wherein said third and fourth contacts are opened under fault conditions by downward movement of said second contact arm relative to said shunt terminal.

11. The circuit breaker of claim 10, wherein said first and second contacts and said second contact arm define a current limiting electrical path when said circuit breaker is in a current limiting position, said current limiting electrical path bypassing said shunt terminal.

12. The circuit breaker of claim 1, further comprising:

a bump positioned for engaging at least one of said contact arms to reset said circuit breaker from said current limiting position to a closed position.

13. The circuit breaker of claim 3, further comprising:

a magnetic shield disposed intermediate said line terminal and said second contact arm.

14. A selective system including a plurality of circuit breakers wherein at least one of said circuit breakers comprises:

a pair of first and second separable contacts defining a first contact pair, a first contact arm carrying said first contact and being electrically connected to a first terminal;

a pair of third and fourth separable contacts defining a second contact pair;

a second contact arm carrying said second and third contacts, said second contact arm being electrically connected to a second terminal, said first and second contacts separable between open and closed positions; and a shunt terminal carrying said fourth contact, wherein said third and fourth contacts are separable between open and closed positions, said shunt terminal comprising a member for providing a first electrical path between said second contact arm and said second terminal, wherein said first and second pairs of contacts are separable under predetermined current conditions.

15. A circuit breaker, comprising:

a first movable contact arm having a first contact thereon, said first movable contact arm being pivotably coupled to a load terminal;

a second movable contact arm having second and third contacts thereon, said second contact and said first contact defining a first contact pair with said first and second contacts separable between open and closed positions, said second movable contact arm being pivotably coupled to a line terminal; and a shunt terminal coupled to said line terminal and providing an electrical path from said second moveable contact arm to said line terminal, said shunt terminal having a fourth contact thereon, said fourth contact and said third contact defining a second contact pair with said third and fourth contacts separable between open and closed positions.

16. The circuit breaker of claim 15, wherein said shunt terminal comprises:

a generally "U" shaped member having an upper portion and side portions, said upper portion being disposed between said first contact arm and said second contact arm so that said fourth contact mates with said third contact.

17. The circuit breaker of claim 15, further comprising:

a pair of springs for effecting opening and closing of said third and fourth contacts.

18. The circuit breaker of claim 17, wherein said pair of springs comprises:

a first spring coupled to said first contact arm and a second spring coupled to said second contact arm.

19. The circuit breaker of claim 15, further comprising:

a bump, positioned for engaging at least one of said contact arms to reset said circuit breaker from said current limiting position to a closed position.

20. The circuit breaker of claim 15, wherein said first and second opened under fault conditions by upward movement of said first contact arm relative to said second contact arm.

21. The circuit breaker of claim 1, wherein the predetermined current conditions comprise overcurrent conditions.

* * * * *